United States Patent [19]

Weinstein

[11] Patent Number: 4,984,709

[45] Date of Patent: Jan. 15, 1991

[54] NON-REVERSING TABLET DISPENSER WITH COUNTER

[75] Inventor: Jack Weinstein, Manchester, N.J.

[73] Assignee: Primary Delivery Systems, Inc., Annandale, N.J.

[21] Appl. No.: 475,371

[22] Filed: Feb. 5, 1990

[51] Int. Cl.[5] ..... G07F 11/04

[52] U.S. Cl. ..... 221/7; 206/536; 221/123; 221/112; 221/2; 221/8

[58] Field of Search ..... 221/2, 7, 8, 112, 114, 221/123, 133, 154, 155, 233, 234, 236, 246, 261, 263, 228, 229, 231, 362, 367; 206/534, 535, 536, 537, 538, 539; 222/217, 218

[56] References Cited

U.S. PATENT DOCUMENTS

| | | | |
|---|---|---|---|
| 533,197 | 1/1875 | Jaeger | 221/266 X |
| 3,270,915 | 9/1966 | Aver | 221/2 |
| 3,365,099 | 1/1968 | McTaggart | 206/535 X |
| 3,407,962 | 10/1968 | Ragan | 221/4 |
| 3,557,747 | 1/1971 | Rigney et al. | 206/534 |
| 3,612,349 | 10/1971 | Thomas | 221/4 |
| 3,688,945 | 9/1972 | Harman, Jr. et al. | 221/8 |
| 3,911,856 | 10/1975 | Ewing | 206/534 |
| 4,078,661 | 3/1978 | Thomas | 206/534 X |
| 4,127,190 | 11/1978 | Sunnen | 206/535 |
| 4,705,182 | 11/1987 | Newel-Lewis | 215/230 |
| 4,756,423 | 7/1988 | Holtsch | 206/534 |
| 4,807,757 | 2/1989 | Rappaport et al. | 206/535 |

FOREIGN PATENT DOCUMENTS

| | | | |
|---|---|---|---|
| 1092770 | 4/1955 | France | 221/266 |
| 1098150 | 7/1955 | France | 221/263 |
| 964410 | 7/1964 | United Kingdom | 221/123 |

*Primary Examiner*—H. Grant Skaggs
*Assistant Examiner*— Druzbick
*Attorney, Agent, or Firm*—Kenneth P. Glynn

[57] ABSTRACT

The present invention is directed to a container for dispensing tablets in a non-reversing manner. The container includes a main container body, an actuator disk and a stop. The main container body is adapted to receive at least one stack of tablets and has an operating orifice and at least one annularly located ejection post. It is adapted to receive and rotatably hold the actuator disk so as to render it rotatable about a central axis. The actuator disk has a first recess which form a complete annulus about the central axis and is coincidental to and mates with the ejection post. The actuator disk also has a recess of width and depth sufficient to receive a predetermined number of one or more tablets, which has an inward end which is at least coincidental with the dispensing orifice when located thereunder and an outward end which is open for tablet dispensing. The container also includes a stop to assure that said actuator disk can only be rotated in one direction.

19 Claims, 3 Drawing Sheets

NON-REVERSING TABLET DISPENSER WITH COUNTER

BACKGROUND OF THE INVENTION

1. Field of the Invention

The present invention is directed to a container for dispensing tablets or the like. More specifically, it is directed to a type of dispenser which provides access to one or more tablets at a time in such a manner that they cannot be replaced e.g. by a placebo and thus, the dispensing is a non-reversing procedure.

2. Prior Art Statement

Numerous tablet dispensers have been developed over the years and some involve attachments to bottles or containers of medicine while others involve redesign of the container itself. Thus, in 1972, U.S. Pat. No. 3,688,945 was issued to Harman, Jr. et al for a recording tablet dispenser which involved a rather complex dispensing mechanism but included day counting and a dispenser with a flip type cover and ratchet that rotated the day marking as the tablet was dispensed.

U.S. Pat No. 4,705,182 issued to Newel-Lewis describes a tablet dispensary which is a device that fits over a medicine container and has means for dispensing the contents while showing a time indicator for the next dispensing of the medication. U.S. Pat. No. 4,127,190 shows a dispenser for tablets in a predetermined order which includes a graduated scale showing the days of the week and thus enabling the user to determine whether or not a pill for a particular day has has been taken. The cap has a rotational feature which enables the user to rotate the dispensing orifice from one stack to the next sequentially.

U.S. Pat. Nos. 3,911,856 and 4,078,661 are directed to medication reminder systems involving pill dispensing from a flat container and include indicia to show the sequence for the user of a particular medication regimen.

U.S. Pat. Nos. 3,407,962 and 3,612,349 issued to J. B. Ragan and Michael Thomas, respectively, are each directed to stacked pills which are dispensed sequentially and whereby a day of the week indicator is included. In the Ragan patent, a rotating ring moves downwardly for dispensing the tablet and simultaneously marks the day of the week while in the Thomas patent a spring loaded piston advances the pills for dispensing and the scale indicates by viewing to the user as to the day of the week for the next pill.

U.S. Pat. No. 4,756,423 to Holtsch shows a pill dispensing mechanism which includes indicia for days and dates or other indicia and has a rotational dispensing mechanism which is used for dispensing different types of pills from the same dispensing mechanism.

U.S. Pat. No. 4,807,757 to Rappaport et al describes a pill dispenser with sequential dispensing means and automatic incremental dispensing control. This device is a complex mechanism involving axial rotation and vertical sliding movement of various parts and achieves the objective of controlled incremental dispensing in a very expensive manner.

Notwithstanding the above cited prior art, it is believed taht the present invention is neither taught nor rendered obvious thereby. The present invention uniquely permits the user of the present invention container to dispense pills in an irreversible or non-reversing manner and the device is able to provide such a feature with only two components in its most basic form, namely, the main body of the container and a disk actuator.

SUMMARY OF THE INVENTION

The present invention is directed to a container for dispensing tablets in a non-reversing manner. The container includes a main container body, an actuator disk and stop means. The main container body is adapted to receive at least one stack of tablets and has an operating orifice and at least one annularly located ejection post. It is adapted to receive and rotatably hold the actuator disk so as to render it rotatable about a central axis. The actuator disk has a first recess which forms a complete annulus about the central axis and is coincidental to and mates with the ejection post. The actuator disk also has a recess of width and depth sufficient to receive a predetermined number of one or more tablets, which has an inward end which is at least coincidental with the dispensing orifice when located thereunder and an outward end which is open for tablet dispensing. The container also includes a stop means to assure that said actuator disk can only be rotated in one direction.

BRIEF DESCRIPTION OF THE DRAWINGS

The present invention is more fully understood when the instant specification is taken in conjunction with the drawings appended hereto.

DETAILED DESCRIPTION OF THE INVENTION

As indicated above, the present invention involves a container for dispensing tablets in a non-reversing manner. By "tablets" is meant any type of pill, tablet, capsule, disk, pellet or other type of basically consolidated solid small, uniform sized material, be it feed, medication, or other type of material. By "non-reversing manner" is meant that the user is unable to reverse the dispensing of the tablet for the purpose of deceiving or hiding the fact that a pill has been taken, e.g., by replacing it with a placebo. Thus, it is one objective of the present invention to prevent the improper removal and substitution of prescription medication or drugs. Additionally, the present invention device is directed to a mechanism which enables controlled dispensing on an automatic basis by the mere rotation of an actuator disk. Thus, the present invention container may be arranged so as to dispense a single tablet at a time or, if the depth of the recess in the actuator is sufficient two or three or more pills at a time. Likewise, by the arrangement of recesses, posts and pill stacks, various combinations of dispensing may be achieved such as alternating sequential or complete exhaustion of one stack followed by the complete exhaustion of a second stack etc.

Figure 1:
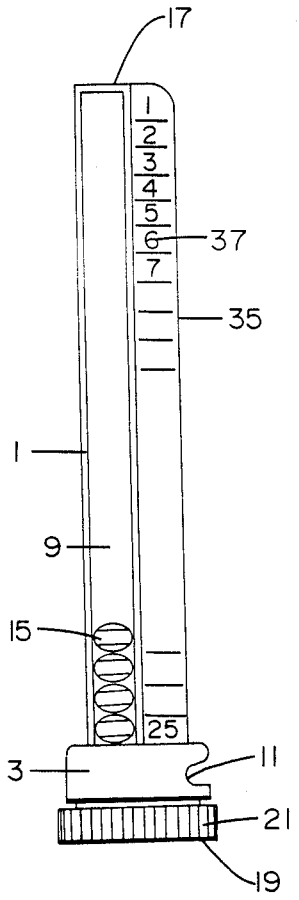
FIG. 1 illustrates a side view of the present invention.

Referring now more specifically to the drawings and FIG. 1, there is shown a container 1 which has stacking means 9. In this particular embodiment, container 1 has a main container body 9 which is adapted to receive a single stack of tablets exemplified by tablet 15. Main container body 9 has an operating end 3 with side orifice 11, as shown. Actuator disk 19 includes gripping ridge 21 so that when the actuator disk 19 is rotated, a tablet is dispensed through side orifice 11. Also shown in FIG. 1 is graduation scale 35 with numerals to provide by numeral 37. The main container body 9 includes a non-operating end 17 which may be unistructural or may be in added non-removable cap or lid.

Figure 2:
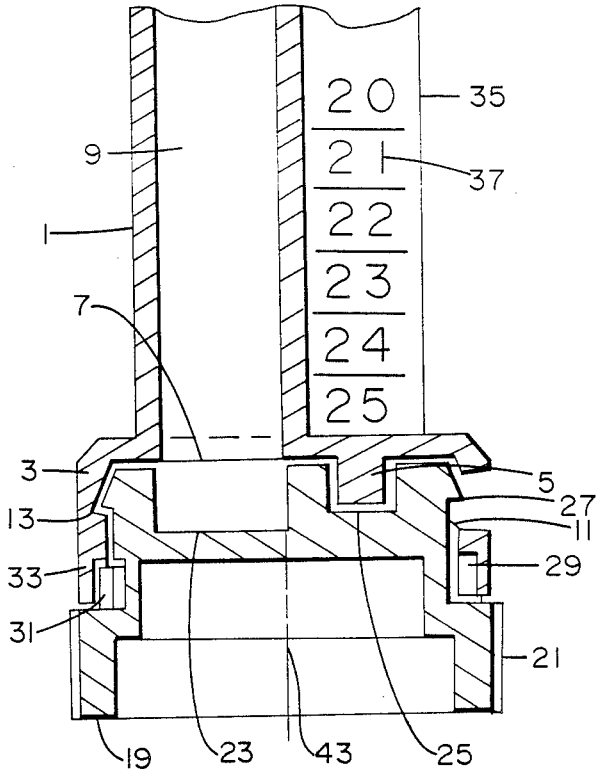
FIG. 2 illustrates a partial side cut view showing the operating end of the container body and the actuator disk of the present invention.

FIG. 2 shows a partial side cut view of a container 1 such as is shown in FIG. 1 and other parts like numbered. In this cut view, ejection post 5 is shown extending away from the main container body 1 at the operating end 3 and ejection post 5 nests or loosely fits into a recess referred to as first recess 25 in actuator disk 19. Dispensing orifice 7 is located at the operating end 3 and stacking column 9 is arranged above the dispensing orifice. Actuator disk 19, in this particular embodiment, rests in nesting recess 13 which is cut into the inside wall 33 of operating end 3. Further, extended wall 33 has side orifice 11 and operating end ratchet typified by rachet 29. Actuator disk 19 has a nesting ridge 27 which nests in nesting recess 13 as shown so that when the user rotates actuator disk 19 by holding and rotating gripping ridges 21, the operating end ratchets 29 work with the actuator disk ratchets 31 so as to permit the actuating disk to be rotated only in a counter-clockwise direction, although they could be arranged so that only a clockwise rotation would be permitted. In any event, the extended wall 33 not only includes ratchets 29 and nesting recess 13, but is also formed unistructurally in this particular embodiment so that only two pieces need be molded to form the entire device.

Actuator disk 19 has a second recess 23 as shown which is at least coincidental with dispensing orifice 7 when located thereunder so that one or more pills of a predetermined number will simply drop into this second recess 23. First recess 25, as mentioned, has ejection post 5 loosely nesting therein and first recess 25 is an annular recess which extends completely around the top of actuator disk 19. While the first recess 25 is of less depth than the second recess 23, it could be of the same depth or even greater depth without exceeding the scope of the invention. In the particular embodiment where the first recess 25 and second recess 23 are of the same depth, the completion of the annular ring formed by first recess 25 will be coincidental in its base with second recess 23 and will appear in its actual width only where it is not coinciding with first recess 25. When actuator disk 19 is rotated about central axis 43 approximately 270 degrees, one or more tablets which drop into second recess 23 are carried around to be stopped in its circular rotation by ejection post 5 and virtually pushed out of the open end of second recess 23 and this is more particularly described in conjunction with FIGS. 3 through 6 discussed hereafter.

Figure 3:
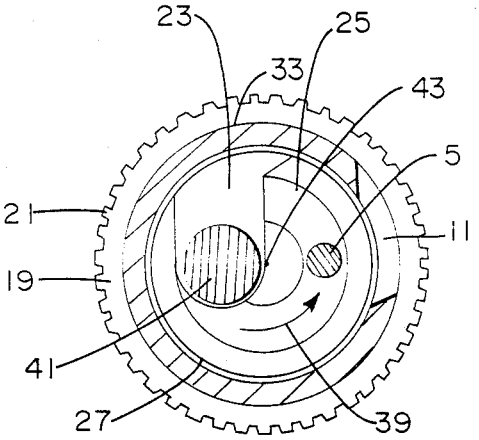
FIG. 3 illustrates a cut top view of the present invention container device shown in FIG. 2 with a tablet in the initially dispensed position.
Figure 4:
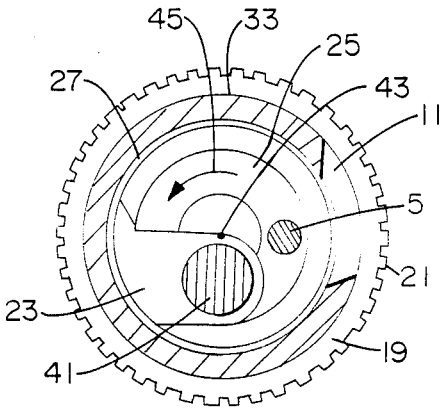
FIG. 4 illustrates a cut top view of the FIG. 2 device but with the actuator disk and the dispensed tablet rotated 90 degrees.
Figure 5:
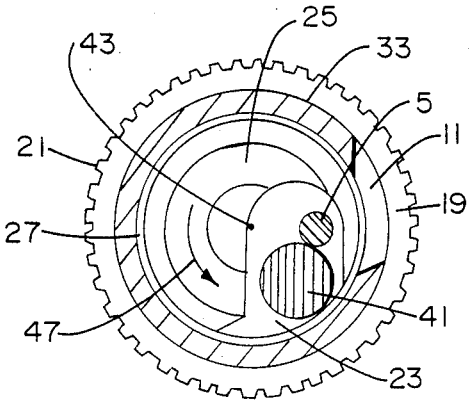
FIG. 5 illustrates a top cut view of the FIG. 2 device with the actuator disk and dispensed tablet rotated so that the ejection post is in contact with the dispensed tablet.
Figure 6:
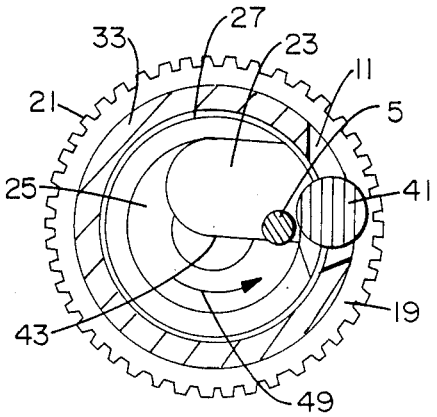
FIG. 6 illustrates a top cut view of the FIG. 2 device wherein the actuator disk is further rotated whereby the ejection post is ejecting the tablet.

FIGS. 3, 4 and 5 show top cut views of the device shown in the previous figures but with a tablet being dispensed. Thus, like parts are like numbered to FIGS. 1 and 2. Specifically, in FIG. 3, a tablet 41 has just been dropped from stacking column 9 into second recess 23. The actuator disk 19 is held at gripping ridges 21 and rotated counter-clockwise as shown by arrow 39. In FIG. 4, the actuator disk has been rotated approximately 90 degrees and the tablet 41 is now at approximately six o'clock and continues to be enclosed by virtue of the second recess 23 and by virtue of stationary wall or extended wall 33 of the operating end of the main container body 1. As can be seen, first recess 25 is an annular recess and moves about without impacting upon ejection post 5. Arrow 45 again shows the direction of rotation and, as shown in FIG. 5, the device has been rotated approximately 180 degrees and tablet 41 is now being pushed by ejection post 5 away from the central axis 43. Upon further rotation as shown by arrow 47 and arrow 49 in FIG. 6, as shown in FIG. 6, tablet 41 becomes ejected by ejection post 5 as the rotation of actuator disk 19 approximates 270 degrees. Thus, the tablet ejects at about three o'clock in this particular embodiment as can be seen from a review of FIGS. 3, 4, 5 and 6, the second recess 23 travels three quarters (¾) of the way around the central axis 43 while the tablet 41 itself only moves approximately 180 degrees and is ejected by virtue of the unique design of the present invention.

Figure 7:
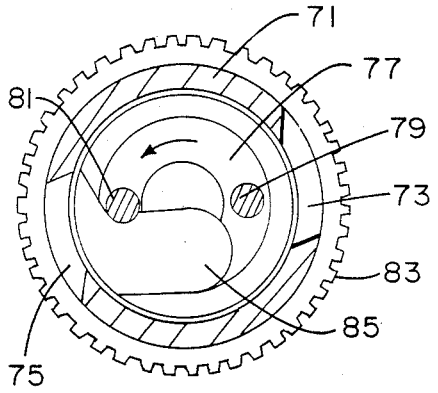
FIG. 7 is a top cut view of an alternative embodiment of the present invention with multiple ejection posts for sequential multiple tablet stacking.

FIG. 7 shows a top cut view of an alternative embodiment of a present invention container wherein two ejection posts 79 and 81 are shown. Thus, second recess 85 of actuator disk 83 moves about as actuator disk 83 is rotated and will receive a tablet (not shown). And will eject a tablet when the second recess 85 is adequately positioned relative to post 79, will receive a second tablet from a second stack (not shown) at approximately twelve o'clock and upon further rotation, will eject a second tablet at ejection post 81. There is also shown a cut cross-section of operating end 71 of a main container body (not shown) and this includes a wall dispensing orifice 73 and a second wall dispensing orifice 75, as shown. It is by virtue of the two posts 79 and 81 as well as the two dispensing orifices 73 and 75 along with dual stacking at approximately 90 degrees off-center from each of the posts which will enable this particular embodiment to alternatively feed tablets from one stack then the other and continue this cycle. First recess 77 of actuator disk 83 is basically identical to that discussed above except that two posts 79 and 81 instead of one post loosely nest therein.

Figure 8:
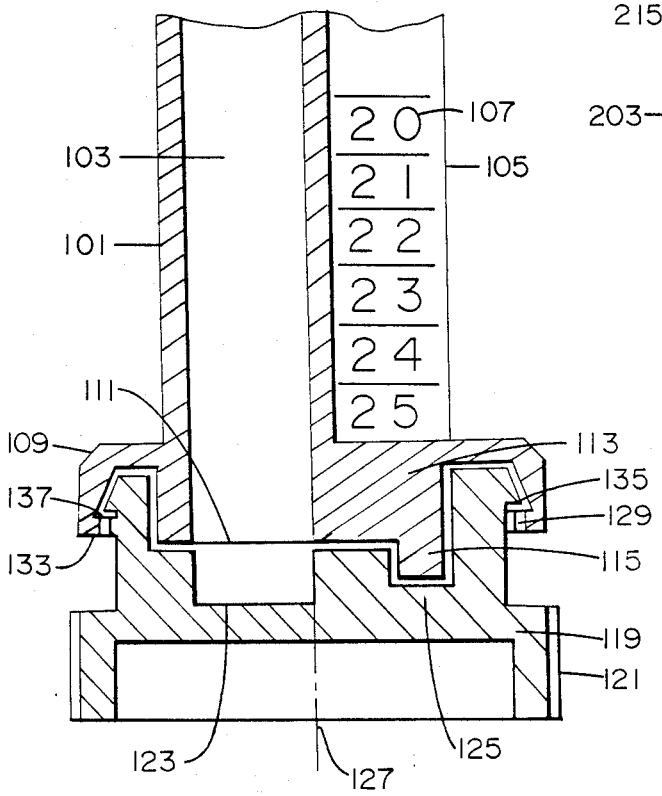
FIG. 8 is a partial side cut view of an alternative embodiment of the present invention with a non-extending operating end of the container body.

FIG. 8 shows a partial side cut view of an alternative embodiment device of the present invention. Thus, there is shown main container body 101 with stacking column 103, graduation scale 105 with typical numeral 107 and operating end 109. In this embodiment, operating end 109 has dispensing orifice 111 and an extended mid-section 113 which continues to form ejection post 115, as shown. Additionally, operating end 109 includes actuator disk nesting recess 137 and ratchets typified by ratchet 129. Due to the fact that operating end 109 is not extended, there is no side orifice on the operating end 109 itself and the second recess 123 of actuator disk 119 will have a flap (not shown) which rides around with actuator disk 119 as it is rotated about central axis 127 and which will only be allowed to open as second recess 123 passes below ejection post 115 so that when a pill or tablet is dispensed by being dropped into second recess 123 and actuator disk 119 is rotated via gripping ridges 121, the tablet will not drop out of the recess until the ejection post 115 forces the pill or tablet out as is typified by the action shown in FIGS. 3 through 6 above. Alternatively. there may be a lock or spring loaded mechanism which would open a flap to permit pill ejection only when a trigger comes into contact with ejection post 115. Other types of mechanisms may now be within the purview of the artisam without exceeding the scope of the invention. Actuator disk 119, in this particular embodiment, includes first recess 125 which travels as an annulus about central axis 127. Further, actuator disk 119 includes ratchets 113 which, when operating with ratchets 129 permit the device to be rotated only in one direction and therefore prevent backfilling.

Figure 9:
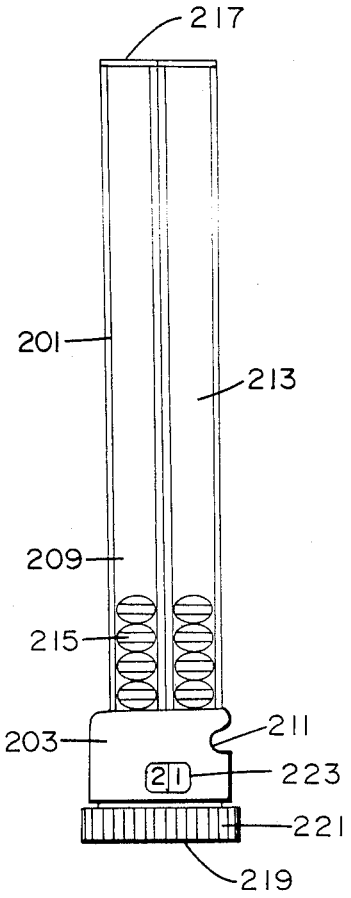
FIG. 9 shows a side view of another container of a present invention which contains a counter.

FIG. 9 illustrates an alternative embodiment showing main body 201 with two stacking columns 209 and 213 respectively and containing typically tablet 215 therein. Operating end 203, in this particular embodiment, has a side orifice 211 for dispensing the pills and when this device is used in conjunction with ejection post and recesses as are shown in FIGS. 3 through 6, all of the tablets in a first column are dispensed before the tablets in a second column begin to be dispensed. Also, in this particular embodiment, a counter such as shown in many of the prior art patents cited above to keep track of the number of tablets dispensed, shown here as counter 223, operates in conjunction with actuator disk 219. For example, a single ratchet tab on the actuator would increase the digit read-out at counter 223 by one digit for each full rotation of actuator disk 219, thus showing the total count of pills or tablets consumed. The main container body 201, in this particular embodiment, has a permanently sealed set of lids typified by lid 217 which permits filling and then permanently sealing tablets. Further, while the illustration only shows four tablets in each column, it is understood that one column may be full while the other column is being depleted. Last, actuator 219 includes gripping ridges 221 as shown.

While the above embodiments represent many of the various features which may be employed in conjunction with the present invention, it should be noted that many alternative embodiments could be included. For example, any one of the above cited embodiments could include a child-resistant safety device such as an extra collar or column which has to be properly aligned before the device will dispense. Alternatively, some kind of a locking mechanism might be employed, for example, a spring release, mechanism which is actuated by pressing up on the underside of a typical actuator disk could engage or disengage to permit rotation. Also, while the particular devices shown in the figure are cylindrical, they certainly could be hexagonal, rectanganal, square or any other shape as long as the actuator disk has at least one round cross-section to enable it to be rotated relative to the main container body. Further, the device may be made of plastic, glass, metal or combinations of these and the choice of material of construction is within the skill of the artisan.

Obviously, numerous modifications and variations of the present invention are possible in light of the above teachings. It is therefore understood that within the scope of the appended claims, the invention may be practiced otherwise than as specifically described herein.

What is claimed is:

1. A container for dispensing tablets in a non-reversing manner, which comprises:

(a) a main container body adapted to receive at least one stack of tablets and having an operating end with at least one annularly located dispensing orifice and at least one annularly located ejection post extending away from said body, and further adapted to receive and rotatably hold an actuator disk so as to render it rotatable about a central axis;

(b) an actuator disc securely and rotatably attached to the operating end of said body so as to render it rotatable about said central axis, said actuator disk having a first recess which forms a complete annulus about said central axis and is coincidental to and mates with said ejection post, and having a second recess of width and depth sufficient to receive a predetermined number of one or more tablets, said second recess having an inward end which is at least coincidental with said dispensing orifice when located thereunder and an outward end which is open for tablet dispensing; and, (c) stop means to assure that said actuator disk can only be rotated in one direction;

such that when said body contains stacked tablets, said actuator disk is rotated so that said second recess is located under said dispensing orifice and at least one tablet drops into said second recess, and upon further rotation, the tablet(s) resting in said second recess is ejected by being pushed against said ejection post.

2. The container of claim 1 wherein said main container body has an end opposite said operating end which permanently sealed and said container is fillable with one or more stacks of tablets before said actuator disk is attached thereto.

3. The container of claim 1 wherein said main container body has an end opposite said operating end which is open and adapted to receive a non-removable lid after filling.

4. The container of claim 1 wherein said main container body has a symmetrical cross-section.

5. The container of claim 1 wherein said main container body is cylindrical and said central axis is the axis of said cylindrical main container body.

6. The container of claim 1 wherein said stop means is a one way ratchet set.

7. The container of claim 1 wherein said main container body is adapted to receive at least two stacks of tablets.

8. The container of claim 1 wherein said main container body operating end includes extended walls and a side orifice therein with said outward end of said actuator disk.

9. The container of claim 1 wherein said main container body operating end includes extended walls which contain one half of a ratchet set located on the inside of said walls and said actuator disk contains the other half of a ratchet set, both halves working cooperatively to constitute said stop means.

10. The container of claim 1 which further includes:

(d) a visible graduation scale connected to main container body and containing indicia to correspond to the number of tablets remaining or consumed, based on a predetermined tablet height.

11. The container of claim 1 which further includes:

(d) a visible graduation scale connected to main container body and containing indicia to correspond to the number of tablets remaining or consumed, based on a predetermined tablet height a counting mechanism attached thereto which displays a digital tablet count which is based on the actual number of tablets dispensed from container.

12. The container of claim 6 wherein said ratchet set has one half located on the operating end of said main container body and the opposite half located about said actuator disk.

13. The container of claim 7 wherein there is only one ejection post and one second recess.

14. The container of claim 7 wherein there are two ejection posts and two stacks of tablets and one second recess such that tablets are dispensable from each of said stacks in an alternating manner.

15. The container of claim 7 wherein there are as many ejection posts as there are stacks of tablets and there is only one second recess.

16. The container of claim 7 which further includes:

(d) a visible graduation scale connected to main container body and containing indicia to correspond to the number of tablets remaining or consumed, based on a predetermined tablet height.

17. The container of claim 7 which further includes:

(d) a visible graduation scale connected to main container body and containing indicia to correspond to the number of tablets remaining or consumed, based on a predetermined tablet height a counting mechanism attached thereto which displays a digital tablet count which is based on the actual number of tablets dispensed from container.

18. The container of claim 11 wherein said counting mechanism is ratchet driven.

19. The container of claim 17 wherein said counting mechanism is ratchet driven.

* * * * *